United States Patent [19]

Ruhl et al.

[11] Patent Number: 4,538,977

[45] Date of Patent: Sep. 3, 1985

[54] ROLLER VANE PUMP WITH ANGULAR RANGES OF APPROXIMATE CONCENTRIC CIRCULAR PATHS FOR THE ROLLERS

[75] Inventors: Karl Ruhl, Niefern; Ulrich Kemmner, Sachsenheim, both of Fed. Rep. of Germany

[73] Assignee: Robert Bosch GmbH, Stuttgart, Fed. Rep. of Germany

[21] Appl. No.: 691,355

[22] Filed: Jan. 14, 1985

Related U.S. Application Data

[63] Continuation of Ser. No. 566,954, Dec. 28, 1983, abandoned, which is a continuation of Ser. No. 53,586, Jun. 29, 1979, abandoned.

[30] Foreign Application Priority Data

Aug. 12, 1978 [DE] Fed. Rep. of Germany ..... 2835457

[51] Int. Cl.[3] ..... F04C 2/00

[52] U.S. Cl. ..... 418/150; 418/225

[58] Field of Search ..... 418/150, 225, 259

[56] References Cited

U.S. PATENT DOCUMENTS

| | | | |
|---|---|---|---|
| Re. 27,241 | 12/1971 | Pace, Jr. et al. | 418/225 |
| 1,271,585 | 7/1918 | Klise | 418/225 |
| 2,359,903 | 10/1944 | Fanning | 418/150 |
| 3,247,803 | 4/1966 | Halsey | 418/225 |

FOREIGN PATENT DOCUMENTS

| | | | |
|---|---|---|---|
| 551083 | 11/1956 | Italy | 418/150 |
| 348231 | 9/1960 | Switzerland | 418/150 |
| 313054 | 4/1930 | United Kingdom . | |
| 527544 | 10/1940 | United Kingdom . | |
| 534510 | 3/1941 | United Kingdom . | |
| 541413 | 11/1941 | United Kingdom . | |
| 816967 | 7/1959 | United Kingdom . | |

*Primary Examiner*—John J. Vrablik

*Attorney, Agent, or Firm*—Edwin E. Greigg

[57] ABSTRACT

A fluid supply pump such as a roller cell pump which includes a multiplicity of individual pumping bodies or rollers held in the grooves of a driven rotor in contact with an eccentrically disposed roller path which, in a certain angular range around the narrowest and widest gap, it is, at each location, virtually identical with a concentric circular path which is drawn around the rotor center point, the path preferably formed by two ellipse halves, for the elliptic shape can be virtually exactly approximated around the apex points of the ellipse by means of its primary circles of curvature to thereby improve the dynamic sequence of operations, for example to increase the sealing effect of the radial gap and to adapt the expansion and compression phases to the opening and closing conditions of the intake and pressure grooves.

8 Claims, 10 Drawing Figures

ROLLER VANE PUMP WITH ANGULAR RANGES OF APPROXIMATE CONCENTRIC CIRCULAR PATHS FOR THE ROLLERS

This is a continuation of copending application Ser. No. 566,954 filed Dec. 28, 1983, now abandoned, which is a continuation of Ser. No. 053,586 filed June 29, 1979, now abandoned.

BACKGROUND OF THE INVENTION

The invention relates to a supply unit for fluids. Supply units for fluids, such as the roller cell pumps which are frequently used for supplying fuel under pressure, are known in a variety of types. As in FIG. 1, which shows the known prior art illustrated in schematic fashion, such pumps include a rotor disc or grooved disc 1 having reception grooves 2 distributed about its circumference in which are located positive-displacement bodies 3. These bodies 3 may be formed as rollers, which are guided and slide in the grooves 2 and which contact an external roller path 4; the path 4 is of circular shape like the circumference of the grooved disc 1 but is, however, eccentrically shifted by a certain given distance at its center, so that crescent-shaped pumping work chambers are created which travel about the circumference of the system and supply the induced fluid, such as fuel, to an external groove 13 and, via the play between the roller and reception element to an internal pressure groove 10 while the fluid to be supplied or the rotor disc 1 rotates along the arrow A in its eccentric displacement with respect to roller path 4. Because of the eccentricity, a widest gap WS between the roller path 4 and the jacket surface of the rotor and a narrowest gap ES result, which gaps naturally are periodically traversed by the rollers 3 in their grooves upon the rotation of the driven rotor.

In order to understand the present invention, it is necessary also to explain the functional sequence of a known roller cell pump to a certain extent, with the aid of FIGS. *2a* through *2c* and FIGS. *3a* through *3e* and the individual working phases represented thereby in order, thus, to clarify the disadvantages inherent therein.

In FIG. 1, the following references are also given, which appear as well in the working phases of FIGS. 2 and 3. $V_1$ and $V_2$ indicate, respectively, the chamber under roller $3_1$ and $3_2$; the crescent-shaped chamber between rollers $3_1$ and $3_2$ and that between rollers $3_2$ and $3_3$ are designated $V_3$ and $V_5$, respectively. The pressure side, extending in each case from the uppermost roller which has passed with widest gap WS, toward the bottom on the left-hand side of the system shown in FIG. 1, is marked D, and the intake side is marked S.

First, the buildup of pressure at the widest gap WS will be described in various working phases with the aid of FIGS. *2a* through *2c*; for the sake of simplification, a supply medium free of bubbles, such as fuel, is assumed. In FIG. *2a*, the roller $3_1$ separates the intake chamber S, in which intake pressure prevails, from the chamber $V_1$ under the roller $3_1$ and from the crescent-shaped chamber $V_3$ between the rollers $3_1$ and $3_2$. A buildup of pressure has not yet occurred in chambers $V_1$ and $V_3$; thus, intake pressure also prevails in chambers $V_1$ and $V_3$. The forwardmost edge 8 of the chamber $V_1$ has not yet reached the overlap area of the protruding chamber portion 9 of the internal pressure groove 10, in which, as in the pressure chamber 11 and the crescent-shaped chamber $V_5$ located in front of the roller $3_2$, operational pressure prevails. The distance of the forward edge 8 from the protruding area 9 of the pressure groove 10 amounts to approximately 10°, as shown.

Within the next 3°, that is, at a distance of 7° between the two parts 8 and 9, a substantial pressure buildup (compression) results in the closed chamber comprising $V_1$ and $V_3$, as a result of the reduction in volume of chamber $V_3$ (FIG. *2b*). Within these 3°, a substantial pressure peak of over 10 bar can occur in this chamber $V_1$ plus $V_3$, as a result of which, roller $3_2$ lifts from its previous contact at the rearward groove edge (as seen in the direction of rotation. As a result, there is a connection of the crescent-shaped chamber $V_3$ and chamber $V_1$ with the pressure chamber over the area through which the arrow B extends. The chamber $V_1$ under the roller $3_1$ is, as may be seen, not yet directly connected with the pressure groove 10.

Only in the working phase shown in FIG. *2c* are both the crescent-shaped chamber $V_3$ and the chamber $V_1$ first connected with the pressure chamber 11 via the pressure groove 10, whereby the fluid, displaced out of the chamber $V_3$, flows past the rollers $3_1$ and $3_2$ into the pressure chamber in accordance with arrows B and B'.

The working phases shown in FIGS. *3a* through *3e* show the pressure conditions and the sealing at the narrowest gap ES with pumping bodies or rollers $3_1$, $3_2$ and $3_3$, in the meantime, having traveled farther in the rotary direction. As may be seen, the intake chamber or intake spheroid 12 extends nearly to the narrowest gap ES and, in the working phase shown in FIG. *3a*, is already connected with the chamber located in the area of roller $3_3$. At this point, the crescent-shaped chamber $V_3$ is connected as indicated by arrow C with an external pressure groove 13 whereby the fluid displaced out of the crescent-shaped chamber $V_3$ flows via the external pressure groove 13 and, according to arrow E, past the roller $3_2$ via the inner pressure groove 10 into the pressure chamber 11. The gap width at the narrowest gap ES determines the leakage quantity overflowing out of the crescent-shaped chamber $V_5$ formed between rollers $3_3$ and $3_2$ and into the intake chamber. In the crescent-shaped chamber $V_5$, operational pressure prevails.

In the working phase of FIG. *3b*, the connection from chamber $V_2$ under roller $3_2$ via the inner pressure groove 10 to the pressure chamber 11 is interrupted, for the groove bottom area 14 at that point is just leaving the inner pressure groove 10. The fluid displaced out of chamber $V_2$ and the crescent-shaped chamber $V_3$, which is becoming narrower and narrower, flows via the external pressure groove 13 according to arrow F into the pressure chamber, whereby chamber $V_5$ is still connected via the external pressure groove 13 with the pressure chamber and a leakage quantity continues to overflow into the intake chamber area.

Only in the working phase of FIG. *3c* is the chamber $V_5$ first separated by the roller $3_2$ from the external pressure groove 13 whereby the pressure in chamber $V_5$ rapidly drops as a result of the quantity of overflow across the narrowest gap ES. Roller $3_2$ is pressed by the operational pressure in chamber $V_2$ and the crescent-shaped chamber $V_3$ against the forward groove edge, as shown at reference numeral 15, and thus seals off chambers $V_2$ and $V_3$ from chamber $V_5$. From this moment, the leakage quantity at the narrowest gap is no longer determined by the gap width of distance but rather by the remaining volume of chamber $V_5$ whereby the fluid, further displaced out of chambers $V_2$ and $V_3$, flows via the external pressure groove 13 into the pressure chamber 11. Between groove 13 and chamber 11, there is a connection which is not shown.

In the working phase of the parts in FIG. 3*d*, the roller $3_2$ seals off chambers $V_2$ and $V_3$ from the intake chamber at the narrowest gap, because the roller $3_2$ continues in contact with the forward groove edge. From this point on, the chamber $V_2$ under the roller $3_2$ becomes larger, because the roller $3_2$, with the roller path growing increasingly distant from the rotor, moves farther and farther out of its groove. Simultaneously, the gap 16 between the rear groove edge and the roller path grows smaller and smaller and finally reaches the gap distance established by the narrowest gap ES.

The operational pressure available in chamber $V_2$ then drops as well, when the quantity flowing from chamber $V_3$ toward chamber $V_2$ is smaller than the volumetric increase of chamber $V_2$ resulting from the further rotation of the rotor.

In the working phase of the parts as shown in FIG. 3*e*, the rear groove edge is at the narrowest gap ES and the gap between groove edge 17 and roller path has reached the minimum. As seen on the leakage quantity flowing through the narrowest gap ES is smaller than the volumetric enlargement of chamber $V_2$, the roller $3_2$ lifts from the forward groove edge at 18 and the pressure in chamber $V_2$ drops practically at once to the lesser intake pressure, or below. The difference between the particular groove volume and the roller volume each time a roller traverses the narrowest gap ES is the so-called clearance volume, which is reduced upon traversal of the narrowest gap ES from the operational pressure to the intake pressure.

In such a supply pump for fluids having an eccentric, circular roller path, difficulties arise which may be quite substantial as a result of the lack of sealing at the narrowest gap and as a result of unfavorable expansion and compression relationships after the narrowest gap ES and before the widest radial gap WS, particularly (with respect to a fuel supply pump) during so-called hot-gasoline operation.

Since the sealing point between the pressure chamber D and the intake chamber S is formed only by a jacket line having the desired radial play (ES) of a few $\mu$m and, as explained above, the distance between the rotor and the roller path rapidly increases with increasing distance from the narrowest gap ES, a large quantity of fuel can flow back from the pressure side to the intake side and there cause functional interruptions as a result of volatilization, particularly during hot-gasoline operation.

The beginning of the intake spheroid 12 must also not be brought too close to the narrowest gap ES, because otherwise a direct connection could result between the pressure side and the intake side as a result of a shortcut via the roller groove in the rotor disc. However, this has the result that, after the narrowest gap, there is an expansion of the sealed chamber volume which, until the intake spheroid is opened, that is, until the intake spheroid 12 is reached, can cause significant underpressures, so that the return flow of fuel and its volatilization are still further encouraged.

Furthermore, at the closing of the intake spheroid 12 before the widest gap WS (see FIGS. 2*a*–2*c*), that is, when a particular roller area leaves the intake spheroid area, a compression phase has already occurred for the external partial chamber volume between the rotor and the roller path, while, in contrast, the inner partial chamber volume in the roller groove enlarges still further, which can also have undesirable effects.

There is accordingly a need for a supply unit for fluids whose basic concept corresponds to a roller cell or vane cell pump and in which the disadvantages of the known eccentric circular roller path which are described above are avoided, that is, in which the sealing effect of the radial gap is increased and the expansion and compression phases are adapted to the opening and closing conditions of the intake and pressure spheroids.

OBJECT AND SUMMARY OF THE INVENTION

The supply unit for fluids constructed in accordance with the invention has the advantage over the prior art in that the radial play between the roller path and the grooved disc which is adjustable by means of displacement of the intermediate plate which forms the roller path in an interior bore—that is, generally stated, the radial play which is adjustable by means of a relative displacement between the intermediate plate and the rotor or grooved disc—can be kept approximately constant over a large angular range before and after the narrowest gap in the form of the roller path in accordance with the invention, in fact, over a range of approximately $\pm 20°$ before and after the narrowest gap. This permits the attainment of a substantially better sealing effect compared with that in an eccentric, circular roller path in which the radial play progressively increases with the distance from the narrowest gap.

By means of the transition of the roller path approximating a circular contour concentric with the center of the rotor or grooved disc, the compression phase of the pumping chamber can be terminated quite a distance before the narrowest gap. The closing of the pressure groove can then occur earlier, whereby, in an analogous manner the expansion of the particular pumping chamber is initiated later after the narrowest gap and therefore the intake groove can, accordingly, be opened later.

It is particularly advantageous that the very marked underpressure formation which results from the expansion of the chamber volume after the narrowest gap before the intake groove is opened can, to a great extent, be avoided.

At the widest gap, that is, at the transition from the intake to the pressure side, the approximately circular path of the roller path, which is also concentric with the center of the rotor, means that the intake spheroid can be closed at such a time when both the exterior partial chamber volume and that volume located under the roller have both already terminated their expansion phase. As a result, the course over time of the compression in the region of the negative overlap (that is, when the crescent-shaped chamber $V_3$ and chamber $V_1$ under the roller are connected neither to the pressure side nor the intake side) can be accomplished with a more gradual transition.

In addition, a more gradual process of compression results as the pump continues to rotate further.

The previously referred to relatively high pressure peaks resulting from compression of the fluid in the chamber volume which is entirely closed off at a rotary angle of 10° (see FIGS. 2*a*–2*c*) may be entirely prevented by means of an appropriate positioning of the control edges; that is, this 10° range is so located that it coincides with the angular range in which no compression, or an extremely limited amount of compression, takes place. In addition, this can result in a reduction in noise, because the severe pressure fluctuations which permit a fluctuation of the supply medium are reduced.

In addition, with particular reference to a roller cell pump, there is an additional protection against pressure peaks, even when the peaks have already been reduced to a certain extent automatically by means of appropriate roller movements.

In vane cell pumps, where such a self-regulating function is not present and where previously such pressure peaks could be reduced only via compression oil grooves or bores, this effect of a "braked" compression signifies a decisive improvement.

It is particularly advantageous that the requirement for a concentric, approximately circular course of the roller path about the center of the grooved disc or rotor can be very well accomplished in that the roller path can be composed of two ellipse halves. Then the elliptical shape can almost exactly be obtained in the area of the apex points which approximate primary circles of curvature.

The invention can be realized without comparatively great expense because the centers of the two ellipse halves are identical and, furthermore, the rotor center is not identical with the centers of the particular primary circles of curvature of the ellipses.

The invention will be better understood as well as further objects and advantages thereof become more apparent from the ensuing detailed description of the preferred embodiment taken in conjunction with the drawings.

DESCRIPTION OF THE PREFERRED EMBODIMENT

The basic concept of the present invention is to improve the operation of fluid supply pumps, particularly during hot operation of the medium to be supplied, i.e., in a fuel supply pump, during hot-gasoline operation. By means of a new embodiment of the roller path disposed eccentrically relative to the rotor, with the roller path being so formed that it is virtually, and, from the practical standpoint, approximates a circular course which extends, in a certain angular range about the narrowest and the widest gap, concentrically about the rotor center; that is, about the center of the grooved disc or rotor disc which receives the pumping bodies or rollers in grooves.

Figure 1:
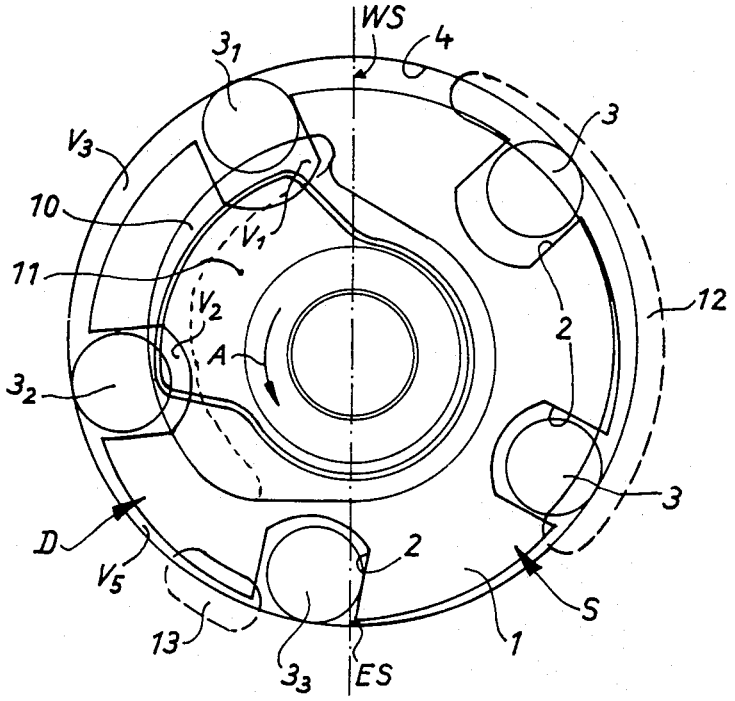
Fig. 1 PRIOR ART
FIG. 1 is a schematic illustration of a well-known roller cell pump.
Figure 2A:
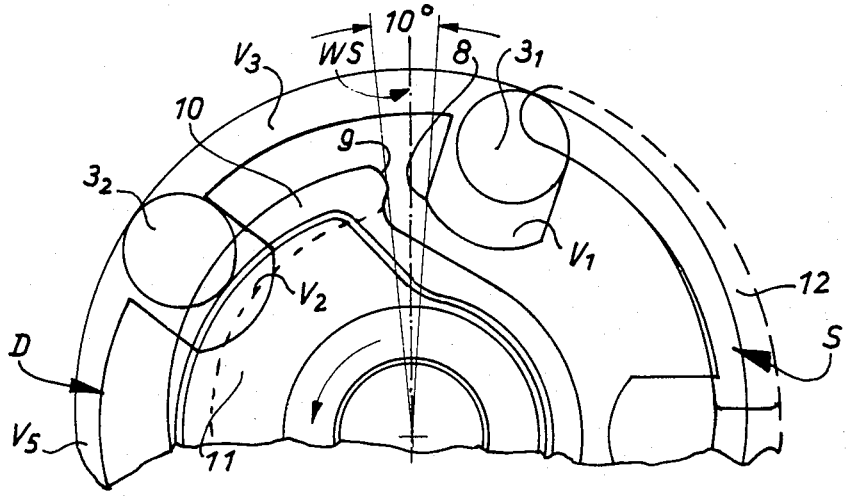
Fig. 2a PRIOR ART
FIG. 2*a* is a schematic illustration similar to FIG. 1 of a portion of a well-known roller cell pump relating to the function and pressure buildup at the widest gap in a first working phase.
Figure 2B:
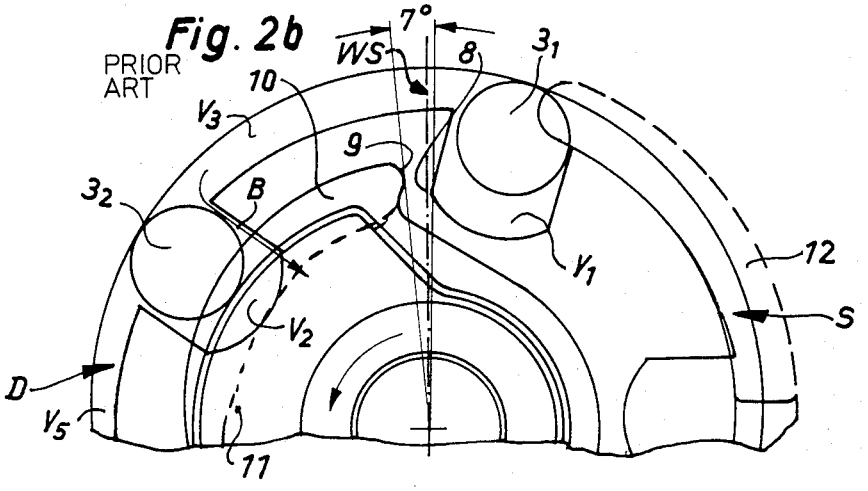
Fig. 2b PRIOR ART
FIG. 2*b* is a view similar to FIG. 2*a* of a second working phase of a well-known roller cell pump.
Figure 2C:
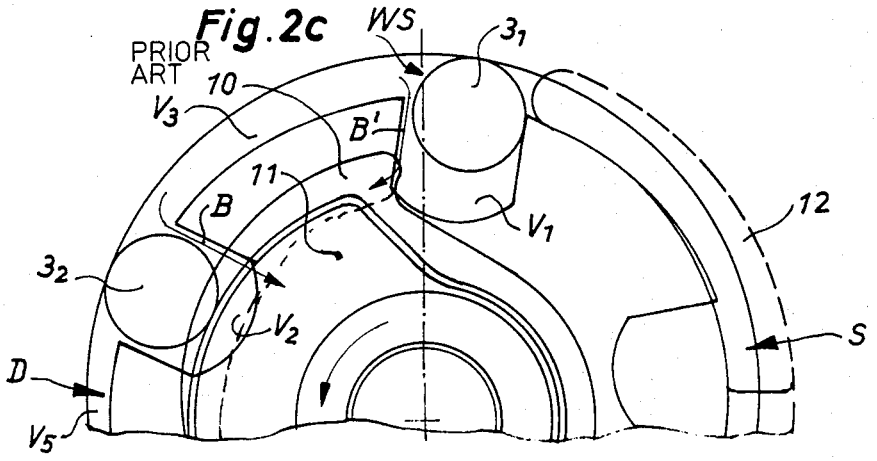
Fig. 2c PRIOR ART
FIG. 2*c* is a view similar to FIG. 2*a* of a third working phase of a well-known roller cell pump.
Figure 3A:
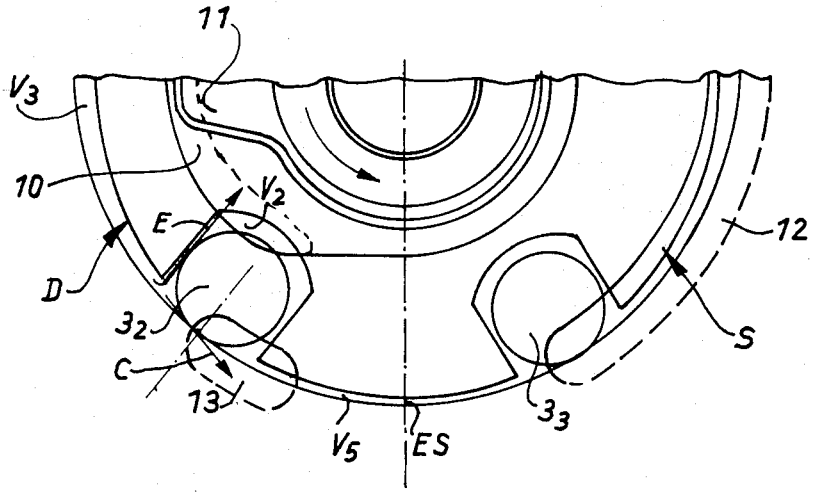
Fig.3a PRIOR ART
FIG. 3*a* is a schematic illustration of the lower portion of the roller cell pump of FIG. 1 illustrating the pressure conditions and the sealings at the narrowest gap in a first working phase.
Figure 3B:
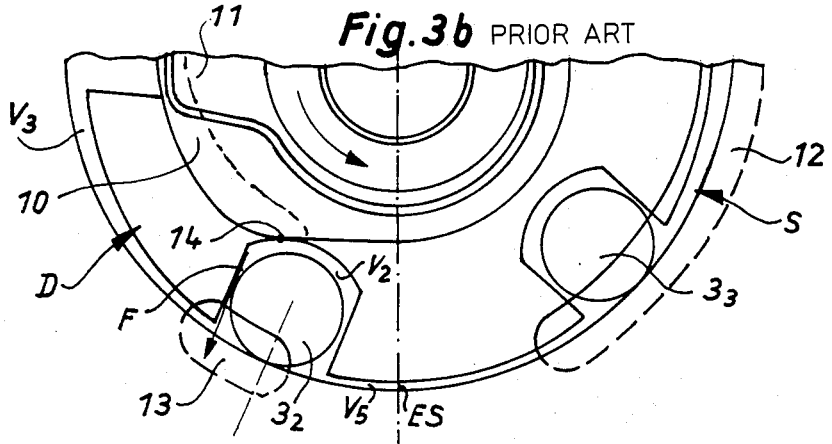
Fig.3b PRIOR ART
FIG. 3*b* is a view similar to FIG. 3*a* showing the parts in a second working phase.
Figure 3C:
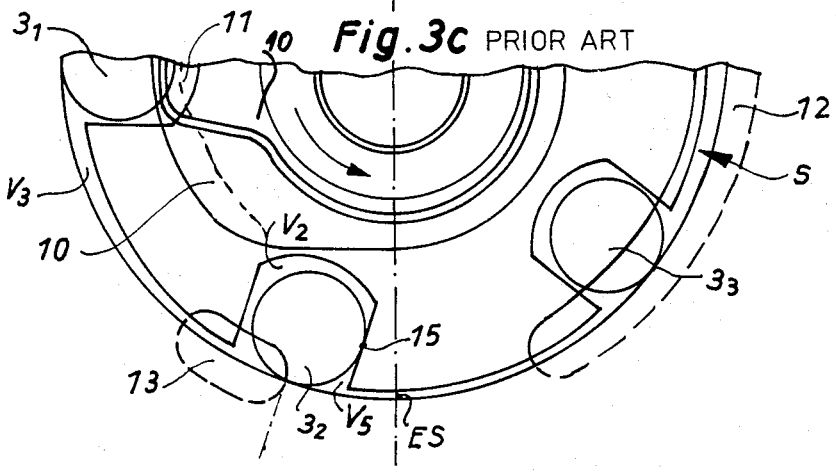
Fig.3c PRIOR ART
FIG. 3*c* is a schematic illustration similar to FIG. 3*a* showing a third working phase of the parts.
Figure 3D:
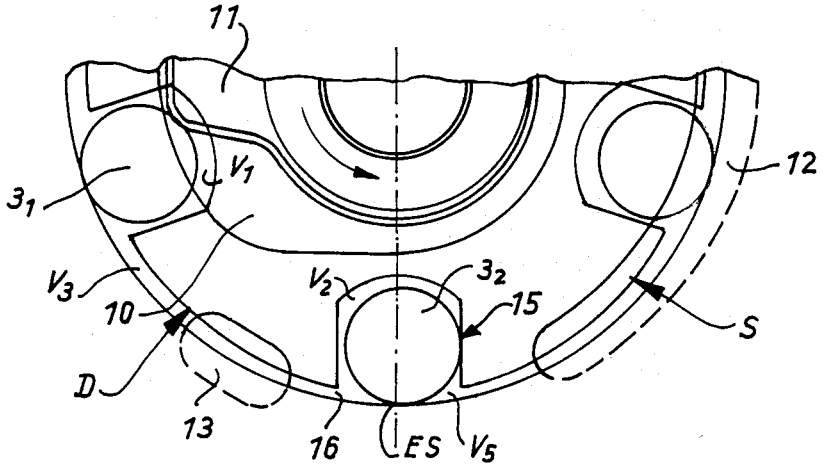
Fig. 3d PRIOR ART
FIG. 3*d* is a schematic illustration similar to FIG. 3*a* showing the parts in a fourth working phase.
Figure 3E:
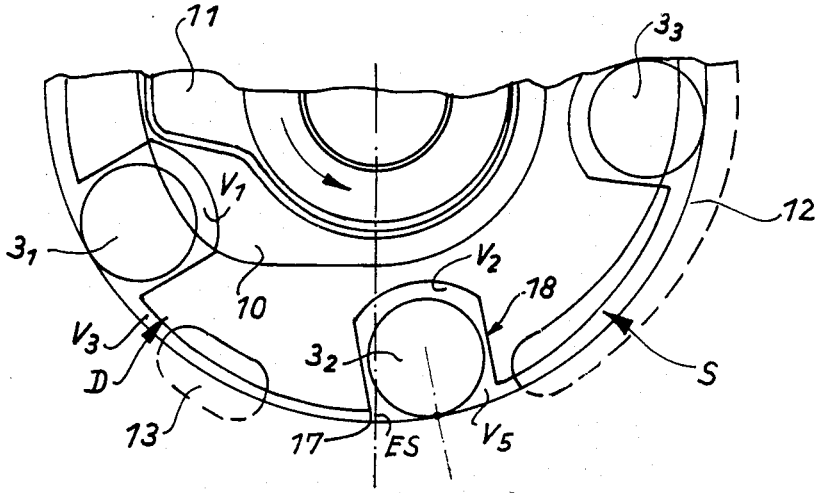
Fig. 3e PRIOR ART
FIG. 3*e* is a schematic illustration similar to FIG. 3*a* showing the parts in a fifth working phase.
Figure 4:
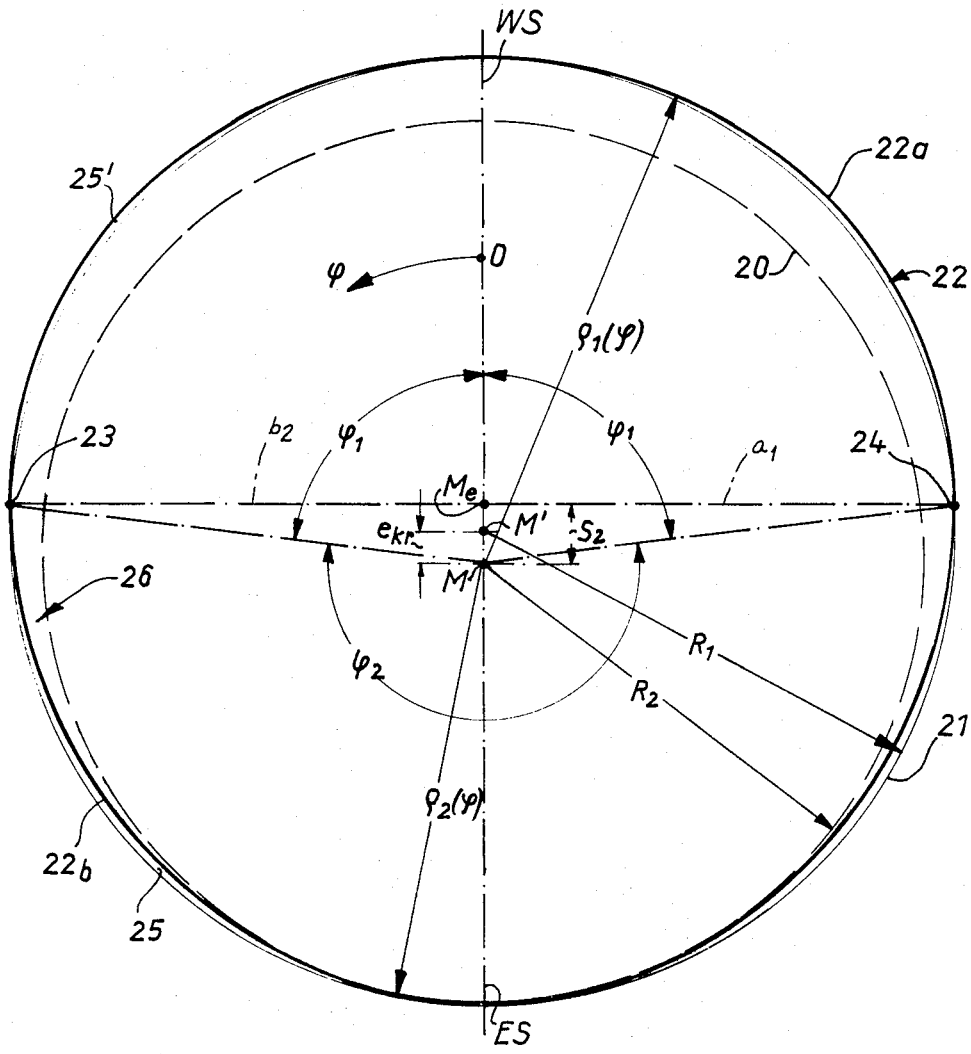
FIG. 4 is a schematic showing of the roller path for the supply pump of the invention operating on the basic principle of a roller piston pump in which the rollers follow a pump inner chamber having a non-circular contour.

As shown in FIG. 4, the rotor or grooved disc center point is indicated at M. From this center M, the radius $R_2$ of the rotor extends which, in rotating about the center M, defines the jacket line of the grooved disc which is shown in broken lines in FIG. 4 and indicated by the reference numeral 20.

In the known circular roller cell pump, there is a center point M′, disposed at a distance $e_{kr}$ and thus eccentrically with respect to the center M of the eccentric circular contour of the known roller path 21 having the radius $R_1$, which path 21 extends as a circle about the center M′ and is depicted in FIG. 4 by a fine line.

The invention departs from the above described arrangement in that in order to form the roller path in accordance with the invention, which is shown in FIG. 4 and depicted by a heavy line and identified by the reference numeral 22, the roller path is divided into two halves, an upper half 22*a*, which comprises somewhat less than a "semicircle" and at 23 and 24 turns into a lower half 22*b*, which is somewhat larger than a "semicircle". The upper and lower halves 22*a*, 22*b* formed respectively by radius vectors $\rho_1(\phi)$ (referring to the upper half 22*a*) and $\rho_2(\phi)$ (referring to the lower half 22*b*) extending about the center M of the grooved disc, the length of these radius vectors being a function of the angle $\phi$.

In the illustrated embodiment, the ellipse halves 22*a* and 22*b* form the roller path for the rollers of the rotor of the pump, which, placed together with transition points at 23 and 24, form the roller path in accordance with the invention. Because the ellipse shape can be virtually exactly approximated in the area of the apex points WS and ES by means of their primary circles of curvature which follow the curvature of a circle in the area of WS and ES as shown by the thin line circle 21 having a center M′, this embodiment of a roller path in accordance with the invention fulfills extraordinarily well the basic concept of the present invention as it has been defined above namely, within a certain angular range about the narrowest and widest gap to be approximately identical with a concentric circle about the rotor center. The narrowest gap is shown between the rotor and the roller path at ES and the widest gap is shown between the rotor and the roller path at WS.

The centers of the two ellipse halves are identical and in FIG. 4 are designated $M_e$. The rotor center M is identical with the centers of respective circles of curvature which centers at M which practically identically represent the ellipse shape in the area of the apex points WS and ES. That is, a circular arc with radius R2 will substantially coincide with the ellipse 22*b* beginning on opposite sides of ES and a circular arc with radius R2+S2 will substantially coincide with ellipse 22*a* beginning on opposite sides of WS.

In other words, based on the foregoing it will be understood that in this structure the roller path formed by the two elliptical halves, having the same geometrical center Me disposed eccentrically to the grooved disc 20 for contact by the rollers is arranged so that the ellipse shape about the apex points WS and ES of the ellipse halves represent approximate circular arcs.

There is a distance $S_2$ between the ellipse center $M_e$ and the rotor center M which is produced by the need for sufficient overlapping of the groove edge with the roller jacket line contacting it.

As seen in FIG. 4 a roller vane pump is formed with an internal casing surface 22 formed by two ellipse halves 22*a* and 22*b* having a geometrical center Me and joined at their ends 23 and 24. The transition from one ellipse half to the next ellipse half has a relatively smooth transition at their joints 23 and 24 because the surfaces so formed are substantially circular arc sections as shown by the circle 21 which coincides with the ellipse halves at 23 and 24 and at the apex ends of the ellipse halves at WS and ES. The smooth roller path formed by the ellipse halves defines a contact surface for the peripheral rollers of the rotor having a center M. The rotor axis is mounted off center from the center of the roller path so that the narrowest point between the rotor and the roller path is at ES and the widest point between the rotor and the roller path is at WS. As seen from the drawing, the rotor center M is not the same as the centers Me of the ellipse halves. The geometric center Me of the two ellipse halves are not identical with the center point M of the rotor. The path formed by the ellipse halves are ellipital with respect to their geometrical centers Me; however, the elliptical path approximates a circular arc along the portion at WS and ES with radii coinciding with the center M of the rotor. Therefore, the ellipse halves approximate a circular arc with respect to the center of the rotor disc when their centers coincide with the center M of the rotor.

The major semi-axis $a_1$ of the upper ellipse half is identical to the minor semi-axis $b_2$ of the lower ellipse half. The constant radius of the primary circle of curvature of the lower ellipse half 22*b* at ES corresponds to the constant radius $R_2$ of the rotor disc. For the upper half 22*a*, the radius of the circle of curvature is equal to the rotor radius $R_2$ plus the center point displacement $S_2$ at WS. This can be easily seen with the aid of the following equations for the roller path, expressed in polar coordinates. For the radius $\rho_1$ dependent on the angle $\phi$ and therefore variable, the following equation results:

$$\rho_1 = (R2 + S2)\frac{S2\cos\phi + \sqrt{R2(R2 - S2\sin^2\phi)}}{R2 + S2\cos^2\phi} \quad (1)$$

where $\rho_1$ lies between the limits of $$\phi_1 = \arctan\left(-\frac{\sqrt{R2(R2 + S2)}}{S2}\right)$$

and $$\phi_1 = \arctan\left(+\frac{\sqrt{R2(R2 + S2)}}{S2}\right)$$

The equation for the lower path or ellipse half 22*b* results in:

$$\rho_2 = R2\frac{S2\cos\phi + \sqrt{(R2 + S2)^2 + (R2 + S2)S2\sin^2\phi}}{R2 + S2\sin^2\phi} \quad (2)$$

where $\rho_2$ lies between the limits of $$\phi_2 = \arctan\left(+\frac{\sqrt{R2(R2 + S2)}}{S2}\right)$$

and $$\phi_2 = \arctan\left(-\frac{\sqrt{R2(R2 + S2)}}{S2}\right)$$

The two radii $\rho_1$ and $\rho_2$ dependent on the angle $\phi$ are each identical at the transition points 23 and 24, as can readily be ascertained by inserting numerical values into the two equations (1) and (2), so that a roller path results having a continuous transition.

The following Table I shows the calculated radii, varying in accordance with the angle $\phi$, of both roller path halves 22*a*, 22*b* as an embodiment of the invention although it should be understood that the invention is, of course, not limited to this. The calculated values, however, demonstrate particularly well the advantages which result in the practical operation of a roller cell pump or a comparable unit on the basis of the roller path in accordance with the invention.

The following values are the basis for the calculation:

$R_2 = 15$ mm $S_2 = 2$ mm while in FIG. 4, on the same scale, $R_1$ has a value of 16 mm and the eccentric distance $e_{kr}$ amounts to 1 mm.

TABLE I

| 1 | | | 2 | | |
|---|---|---|---|---|---|
| 0° | 17.000 | 360° | 82.86 | 16.094 | 277.14 |
| 2 | " | 358 | 84 | 16.054 | 276 |
| 4 | " | 356 | 86 | 15.986 | 274 |
| 6 | " | 354 | 88 | 15.921 | 272 |
| 8 | " | 352 | 90 | 15.858 | 270 |
| 10 | 17.000 | 350 | 92 | 15.797 | 268 |
| 12 | 16.999 | 348 | 94 | 15.740 | 266 |
| 14 | 16.999 | 346 | 96 | 15.684 | 264 |
| 16 | 16.998 | 344 | 98 | 15.632 | 262 |
| 18 | 16.997 | 342 | 100 | 15.581 | 260 |
| 20 | 16.996 | 340 | 102 | 15.534 | 258 |
| 22 | 16.994 | 338 | 104 | 15.489 | 256 |
| 24 | 16.991 | 336 | 106 | 15.446 | 254 |
| 26 | 16.988 | 334 | 108 | 15.406 | 252 |
| 28 | 16.984 | 332 | 110 | 15.368 | 250 |
| 30 | 16.979 | 330 | 112 | 15.332 | 248 |
| 32 | 16.973 | 328 | 114 | 15.299 | 246 |
| 34 | 16.966 | 326 | 116 | 15.268 | 244 |
| 36 | 16.958 | 324 | 118 | 15.239 | 242 |
| 38 | 16.948 | 322 | 120 | 15.213 | 240 |
| 40 | 16.936 | 320 | 122 | 15.188 | 230 |
| 42 | 16.923 | 318 | 124 | 15.166 | 236 |
| 44 | 16.908 | 316 | 126 | 15.145 | 234 |
| 46 | 16.891 | 314 | 128 | 15.126 | 232 |
| 48 | 16.872 | 312 | 130 | 15.109 | 230 |
| 50 | 16.850 | 310 | 132 | 15.094 | 228 |
| 52 | 16.826 | 308 | 134 | 15.080 | 226 |
| 54 | 16.800 | 306 | 136 | 15.068 | 224 |
| 56 | 16.771 | 304 | 138 | 15.057 | 222 |
| 58 | 16.739 | 302 | 140 | 15.047 | 220 |
| 60 | 16.704 | 300 | 142 | 15.039 | 218 |
| 62 | 16.667 | 298 | 144 | 15.032 | 216 |
| 64 | 16.626 | 296 | 146 | 15.025 | 214 |

TABLE I-continued

| 1 | | | 2 | | |
|---|---|---|---|---|---|
| 66 | 16.582 | 294 | 148 | 15.020 | 212 |
| 68 | 16.536 | 292 | 150 | 15.016 | 210 |
| 70 | 16.486 | 290 | 152 | 15.012 | 208 |
| 72 | 16.433 | 288 | 154 | 15.009 | 206 |
| 74 | 16.377 | 286 | 156 | 15.007 | 204 |
| 76 | 16.318 | 284 | 158 | 15.005 | 202 |
| 78 | 16.256 | 282 | 160 | 15.003 | 200 |
| 80 | 16.191 | 280 | 162 | 15.002 | 198 |
| 82.86 | 16.094 | 277.14 | 164 | 15.001 | 196 |
| | | | 166 | 15.000 | 194 |
| | | | 168 | " | 192 |
| | | | 170 | " | 190 |
| | | | 172 | " | 188 |
| | | | 174 | " | 186 |
| | | | 176 | " | 184 |
| | | | 178 | " | 182 |
| | | | 180 | 15.000 | 180 |

The dependence of the radius vectors $\rho_1$ and $\rho_2$ defining the two different elipse halves on the angle $\phi$, at intervals of 2 degrees of angle at a time, may be drawn from the table, whereby at an angle $\phi=82{,}86°$, there is identity of radius vector $\rho_1$ with radius vector $\rho_2$. One moves therefore from the angle 82,86° over from radius $\rho_1$ to radius $\rho_2$ and allows the angle $\phi_2$ for the lower ellipse half 22*b* to continue on from 82,86° up to 277.14°, corresponding to the transition point 24, at which then the radius $\rho_2$, having a numerical value according to the table of 16.094, again turns into the radius $\rho_1$ of the upper ellipse half.

From the table it can be seen that $\rho_1$ is practically constant at four points for an angle $\phi_1=\pm 20°$ in the area of $\phi_1=0$. The same can be seen to occur for the numerical value of 15.00 for $\rho_2$ in the range of 180°±20°. A course of the roller path of this sort about the widest gap WS and the narrowest gap ES is particularly advantageous, as a comparison of the circular courses of rotor disc 20 and circular roller path contour 21 (broken and fine lines; known embodiment forms) shows, which narrow sharply toward the narrowest gap ES and widen out again thereafter, with the conditions which make possible a virtual identity of the roller path according to the invention already more than 20° before the narrowest gap and more than 20° after the narrowest gap, with respect to the circular form of the rotor disc.

In this area, before and after the narrowest gap ES (and analogously applied to the widest gap WS), there is practically no noticeable volume change any longer between the roller path and the grooved disc or rotor jacket, so that here as well no volume displacements can arise which would lead to extreme operating conditions. Still, the roller path in accordance with the invention has practically the same volume-distance relationships, albeit shifted, with the rotor disc, because what is missing, for example, as a very small crescent-shaped chamber 25 in the third quadrant (first forward half of the lower ellipse half 22*b*) appears as a supplementary chamber 25′ in the second quadrant, while the approach of the roller path to the jacket surface of the rotor disc is greatest approximately in the area of 26 and takes a substantially steeper course than in a known, concentric circular roller path. However, this "compression phase" is already terminated long before the narrowest gap; corresponding conditions are found at all the critical transition areas described above, so that the overall result in a substantially gentler, more gradual operation, braked compression, and protection from pressure peaks as well as from the increased wear and possible fluctuations which pressure peaks cause.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. A supply unit for fluids, in particular a fuel supply pump in the form of a roller cell or vane cell pump which is disposed in a common housing with a driving electromotor comprising, in combination, a driven rotor disc having a plurality of grooves, a plurality of individual pumping rollers disposed in said rotor disc grooves, a roller path formed by two ellipse halves having the same geometrical center Me disposed eccentrically to said disc for contact by said rollers, the major semi-axis of one ellipse half being identical to the minor semi-axis of the other ellipse half, whereby the ellipse shape about the apex points WS and ES of said ellipse halves approximate circular arcs of curvature with centers coinciding with said rotor disc, said roller path within an angular range of ±20° about the narrowest and widest gap distances at the apex of said ellipical halves being substantially identical in each area with a concentric circular path about the center of said rotor path.

2. A supply unit in accordance with claim 1, wherein the radius of the approximate circular arc of curvature of the lower ellipse half corresponds to the radius of said rotor disc and wherein the radius of the approximate circular arc of curvature of the upper ellipse half is equal to the radius of said rotor disc plus the center point displacement between the center of said rotor disc and the center of said ellipse halves.

3. A supply unit in accordance with claim 2, wherein the radii ($\rho_1$, $\rho_2$) of the two ellipse halves forming said roller path are a function of an angle ($\phi$) whereby the two radii at two transition points are identical and have their center point in the center point of said rotor disc.

4. A supply unit in accordance with claim 1, wherein the radii ($\rho_1$, $\rho_2$), expressed in polar coordinates having the center point in the center point of said rotor disc, of the roller path composed of two ellipse halves follows the following equations:

$$\rho_1 = (R2 + S2)\frac{S2\cos\phi + \sqrt{R2(R2 - S2\sin^2\phi)}}{R2 + S2\cos^2\phi}$$

where $\rho_1$ lies between the limits of $$\phi_1 = \arctan\left(-\frac{\sqrt{R2(R2 + S2)}}{S2}\right)$$

and $$\phi_1 = \arctan\left(+\frac{\sqrt{R2(R2 + S2)}}{S2}\right)$$

$$\rho_2 = R2\frac{S2\cos\phi + \sqrt{(R2 + S2)^2 + (R2 + S2)S2\sin^2\phi}}{R2 + S2\sin^2\phi}$$

where $\rho_2$ lies between the limits of $$\phi_2 = \arctan\left(+\frac{\sqrt{R2(R2+S2)}}{S2}\right)$$

and $$\phi_2 = \arctan\left(-\frac{\sqrt{R2(R2+S2)}}{S2}\right)$$

wherein R2 is the constant radius of said rotor disc and S2 is the distance of the ellipse center point ($M_E$) from the rotor disc center point (M).

5. A supply unit in accordance with claim 3, wherein in addition to the identity of the two radii ($\rho_1$, $\rho_2$) at the transition of points, the slopes, that is, the first derivatives of the functions representing the curve, are also identical at said transition points.

6. A supply unit in accordance with claim 1 wherein radii ($\rho_1$, $\rho_2$), expressed in polar coordinates having the center point in the center point of said rotor disc, of the roller path composed of two ellipse halves follows the following equations:

$$\rho_1 = (R2+S2)\frac{S2\cos\phi + \sqrt{R2(R2 - S2\sin^2\phi)}}{R2 + S2\cos^2\phi}$$

where $\rho_1$ lies between the limits of $$\phi_1 = \arctan\left(-\frac{\sqrt{R2(R2+S2)}}{S2}\right)$$

and $$\phi_1 = \arctan\left(+\frac{\sqrt{R2(R2+S2)}}{S2}\right)$$

$$\rho_2 = R2\frac{S2\cos\phi + \sqrt{(R2+S2)^2 + (R2+S2)S2\sin^2\phi}}{R2 + S2\sin^2\phi}$$

where $\rho_2$ lies between the limits of $$\phi_2 = \arctan\left(+\frac{\sqrt{R2(R2+S2)}}{S2}\right)$$

and $$\phi_2 = \arctan\left(-\frac{\sqrt{R2(R2+S2)}}{S2}\right)$$

wherein R2 is the constant radius of said rotor disc and S2 is the distance of the ellipse center point ($M_E$) from the rotor disc center point (M).

7. A supply unit in accordance with claim 2 wherein radii ($\rho_1$, $\rho_2$), expressed in polar coordinates having the center point in the center point of said rotor disc, of the roller path composed of two ellipse halves follows the following equations:

$$\rho_1 = (R2+S2)\frac{S2\cos\phi + \sqrt{R2(R2 - S2\sin^2\phi)}}{R2 + S2\cos^2\phi}$$

where $\rho_1$ lies between the limits of $$\phi_1 = \arctan\left(-\frac{\sqrt{R2(R2+S2)}}{S2}\right)$$

and $$\phi_1 = \arctan\left(+\frac{\sqrt{R2(R2+S2)}}{S2}\right)$$

$$\rho_2 = R2\frac{S2\cos\phi + \sqrt{(R2+S2)^2 + (R2+S2)S2\sin^2\phi}}{R2 + S2\sin^2\phi}$$

where $\rho_2$ lies between the limits of $$\phi_2 = \arctan\left(+\frac{\sqrt{R2(R2+S2)}}{S2}\right)$$

and $$\phi_2 = \arctan\left(-\frac{\sqrt{R2(R2+S2)}}{S2}\right)$$

wherein R2 is the constant radius of said rotor disc and S2 is the distance of the ellipse center point ($M_E$) from the rotor disc center point (M).

8. A supply unit in accordance with claim 3 wherein radii ($\rho_1$, $\rho_2$), expressed in polar coordinates having the center point in the center point of said rotor disc, of the roller path composed of two ellipse halves follows the following equations:

$$\rho_1 = (R2+S2)\frac{S2\cos\phi + \sqrt{R2(R2 - S2\sin^2\phi)}}{R2 + S2\cos^2\phi}$$

where $\rho_1$ lies between the limits of $$\phi_1 = \arctan\left(-\frac{\sqrt{R2(R2+S2)}}{S2}\right)$$

and $$\phi_1 = \arctan\left(+\frac{\sqrt{R2(R2+S2)}}{S2}\right)$$

$$\rho_2 = R2\frac{S2\cos\phi + \sqrt{(R2+S2)^2 + (R2+S2)S2\sin^2\phi}}{R2 + S2\sin^2\phi}$$

where $\rho_2$ lies between the limits of $$\phi_2 = \arctan\left(+\frac{\sqrt{R2(R2+S2)}}{S2}\right)$$

and $$\phi_2 = \arctan\left(-\frac{\sqrt{R2(R2+S2)}}{S2}\right)$$

wherein R2 is the constant radius of said rotor disc and S2 is the distance of the ellipse center point ($M_E$) from the rotor disc center point (M).

* * * * *